United States Patent [19]

McGarr

[11] Patent Number: 4,519,341

[45] Date of Patent: May 28, 1985

[54] HEATED WATER-ALCOHOL INJECTION SYSTEM FOR CARBURETED INTERNAL COMBUSTION ENGINES

[76] Inventor: Clarence D. McGarr, 6018 - 133rd Ave., NE., Lake Stevens, Wash. 98258

[21] Appl. No.: 405,598

[22] Filed: Aug. 5, 1982

[51] Int. Cl.[3] ..... F02D 19/00

[52] U.S. Cl. ..... 123/1 A; 123/25 B; 123/25 E; 123/25 L; 123/549; 123/575

[58] Field of Search ..... 123/25 L, 25 B, 25 F, 123/25 E, 557, 546, 549, 1 A, 575

[56] References Cited

U.S. PATENT DOCUMENTS

| | | | |
|---|---|---|---|
| 2,746,440 | 5/1956 | Eriksen | 123/557 |
| 3,968,775 | 7/1976 | Harpmand | 123/25 B |
| 3,986,486 | 10/1976 | Rabbiosi | 123/557 |
| 4,333,422 | 6/1982 | Mahoney | 123/25 L |
| 4,364,370 | 12/1982 | Smith et al. | 123/25 L |
| 4,370,970 | 2/1983 | Kunz | 123/557 |
| 4,385,593 | 5/1983 | Brooks | 123/25 F |

*Primary Examiner*—E. Rollins Cross

*Attorney, Agent, or Firm*—Boniard I. Brown

[57] ABSTRACT

This alcohol-water injection system first electrically heats a alcohol-water mixture to a superheated gaseous state, then utilizes the vacuum conditions in the carburetor to control the flow of the gaseous alcohol-water mixture into the intake manifold of the engine where it is mixed with gasoline and air from the carburetor to power the engine.

20 Claims, 3 Drawing Figures

HEATED WATER-ALCOHOL INJECTION SYSTEM FOR CARBURETED INTERNAL COMBUSTION ENGINES

BACKGROUND OF THE INVENTION

This invention relates to fuel intake systems for internal combustion engines which use a primary fuel in which a secondary fuel is injected by a supplementary injection system. Still more particularly, this invention relates to such a supplementary injection system in which the secondary fuel comprises a mixture of alcohol and water which is electrically heated to a superheated gaseous state prior to injection into the intake system of the internal combustion engine.

A vast number of supplemental injection systems for internal combustion engines have been proposed in recent years to improve the economy and performance of conventional internal combustion engines. Several different systems have appeared in popular publications which involve the injection of water or water-alcohol liquid mixtures into the carburetor inlet of a conventional gasoline engine. These have all been relatively simple systems involving a remote tank for the water or water-alcohol mixture liquid, usually a pump, and a nozzle sprayer located in the air cleaner assembly such that the water or water-alcohol mixture may be sprayed directly into the carburetor throat during the operation of the gasoline engine.

A much more sophisticated system is disclosed in U.S. Pat. No. 4,244,328 to Lindstrom in which exhaust gases from an internal combustion engine are recirculated through a remote tank containing a lower alcohol which is reformed by the action of the heated exhaust gases to form a gaseous mixture of hydrogen and carbon monoxide which is then returned to the intake of the internal combustion engine with beneficial reduction in the amount of noxious components and aldehydes in the exhaust gas from the engine. A primary fuel preheating device is disclosed in U.S. Pat. No. 4,259,937 to Elliott. This device raises the temperature of the incoming gasoline to an effective level immediately upstream from the carburetor. No supplemental fuels or fuel mixtures are involved in this reference, however. Finally, U.S. Pat. No. 4,050,419 to Harpman et al discloses a hot fuel gas generator which superheats an incoming fuel mixture of gasoline and water to a very high temperature and then uses a primitive fuel injection system to convey the hot gaseous mixture combined with air to the intake manifold of the internal combustion engine. Only a single primary fuel plus water is utilized in this reference. A very similar system is disclosed in U.S. Pat. No. 4,114,566. Other references of interest include U.S. Pat. Nos. 4,031,864, 3,551,643, 3,498,279, 3,783,236, and 3,439,149.

Several of these systems, particularly the Harmpan and Elliott systems, are potentially very dangerous in that they electrically heat raw gasoline to a very high temperature. The potential for disasterous explosion is very real in these systems. None of the above references disclose a system in which a water and alcohol fuel mixture may be superheated to a gaseous state under relatively safe conditions for effectively controlled introduction into the intake system of a internal combustion engine powered by a different primary fuel, most commonly gasoline.

SUMMARY OF THE INVENTION

The heated water and alcohol injection system for a gasoline burning internal combustion engine of this invention comprises means for storing a water and alcohol liquid mixture, means for heating this mixture to a gaseous state, pump means in combination with fluid conduit means to convey the mixture from the storage means to the heating means, backflow vent means connecting a point in the fluid conduit means intermediate the pump means and the heating means to the storage means, and means to controllably deliver the heated mixture to the fuel intake system of the engine.

The system of this invention produces important advantages in significantly increased fuel economy for engines equipped with the supplemental injection system. Also, if the supplemental injection system of this invention can be actuated prior to starting the engine, the introduction of the superheated water-alcohol mixture in conjunction with the normal gasoline-air starting mixture will ensure quick and positive starting of the engine. Further, the system of this invention has been designed such that its operation is automatic once it has undergone initial adjustment to the demands of the particular engine upon which it is installed. Finally, the system of this invention remains as a supplemental system and, should it fail, the engine will be able to operate in a normal manner by utilizing its conventional primary fuel intake system.

It has also been noticed that the combustion chambers within the internal combustion engines serviced by the heated water-alcohol supplemental injection system of this invention remain remarkably free of carbon deposit buildups which almost invariably detrimentally occur in conventional internal combustion engines without supplemental water-alcohol injection systems. Presumably, this is due to the solvent properties of the added steam component within the combustion chambers of the engine. Further, the presence of the water vapor within the combustion chambers seems to provide for longer engine life.

It is therefore an object of this invention to provide for a heated water-alcohol supplemental injection system which will increase the efficiency of a conventionally operated internal combustion engine.

It is a further object of this invention to provide for a heated alcohol-water supplemental injection system which will operate efficiently and automatically.

It is yet another object of this invention to provide for a supplemental injection system which ensures quick and reliable starting behavior of the engine.

It is yet another object of the system of this invention to provide for fail-safe operation of the supplemental heated water-alcohol injection system.

DETAILED DESCRIPTION OF THE INVENTION

Figure 1:
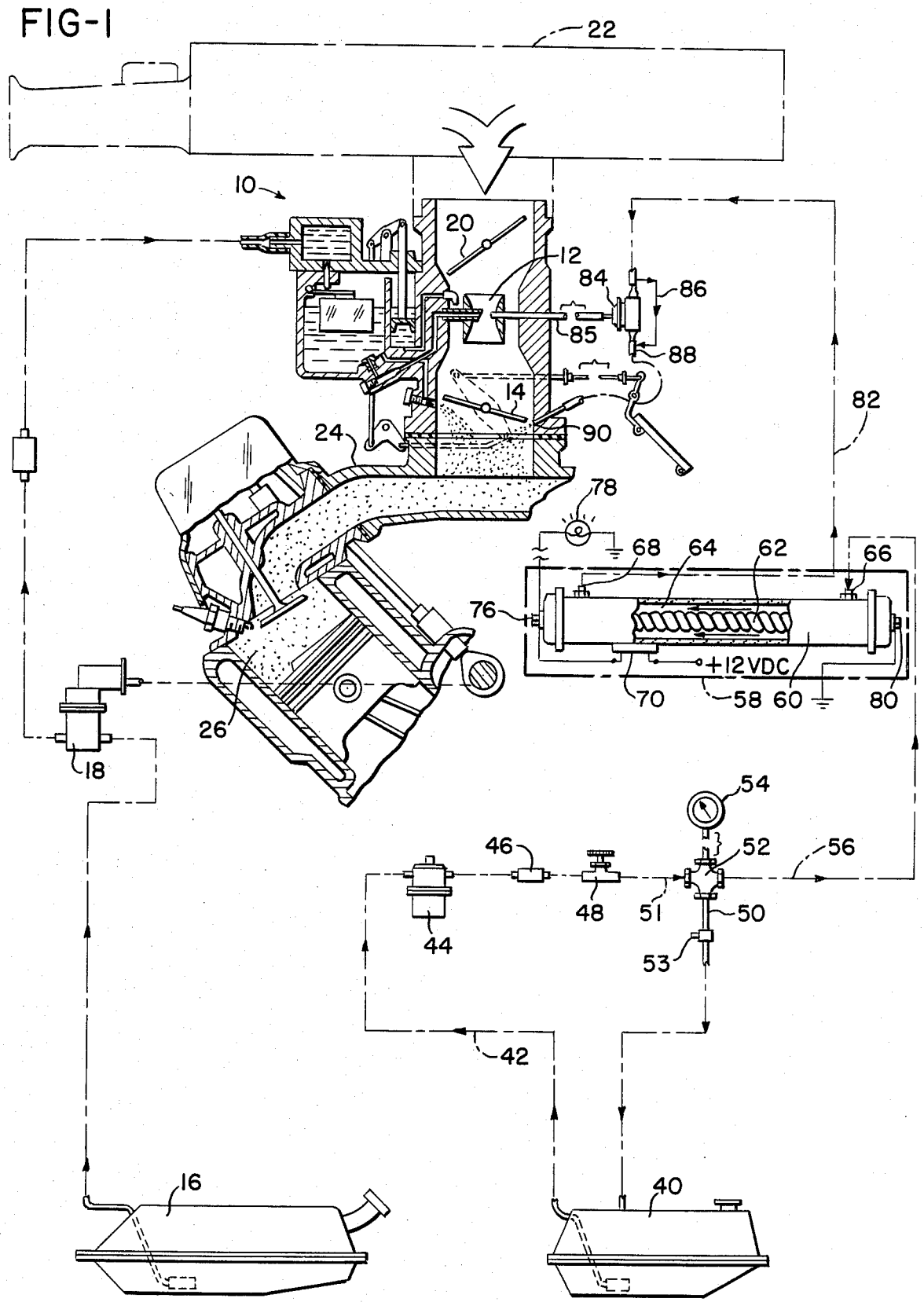
FIG. 1 shows a cross-sectional view of the fuel intake system of a conventional gasoline engine employing one embodiment of the system of this invention under idling conditions for the engine.

The heated water-alcohol injection system of this invention will be described in the context of a conventional internal combustion engine whose primary fuel intake system comprises a gasoline fed carburetor. A partially cut away and partically schematic view of the system of this invention for an engine under idle conditions is shown in FIG. 1. The conventional carburetor 10 has a choke plate 20, a throttle plate 14, a venturi section 12, an air intake system 22 comprising an air cleaner and air filter, not shown, as well as other conventional parts not numbered. The carburetor 10 sits atop a conventional intake manifold 24 which feeds the fuel air mixture into the various combustion chambers 26. Gasoline is supplied to the carburetor 10 from a gas tank 16 by a fuel pump 18. A cold idle condition for the engine is shown by the substantially closed positions of the choke plate 20 and the throttle plate 14. A warm idle condition for the engine would be similar except for the attitude of the choke plate 20 which would be substantially vertical under warm conditions. In this embodiment the supplemental heated water-alcohol injection system comprises a remote alcohol-water tank 40 from which the liquid water-alcohol fuel mixture is gathered by a line 42 by the action of an electric fuel pump 44 which then feeds through a filter means 46 into a needle valve 48 which allows for initial adjustments to the operation of the supplemental injection system. Fluid conduit means 51 then conduct the liquid water-alcohol mixture into a four-way junction 52.

Under normal operating conditions, vacuum conditions of the carburetor 10 a the outlet of 90 of the supplemental injection system will create a suction in the various fluid conduit means downstream from the four-way junction 52. Therefore, under normal demand conditions, the liquid water-alcohol mixture will flow through line 56 into the heating chamber 64 through the inlet 66. Within the heating chamber 64 the water-alcohol mixture will be superheated to a vapor phase by the action of heating coil 62. This heating will cause an expansion and resulting pressure increase which will cause the vapor phase water-alcohol mixture to leave the heating chamber 64 through the outlet 68 and on towards the fuel intake system of the engine by fluid conduit means 82. However, it is not necessary or desirable to employ a full flow of the alcohol-water fuel mixture into the engine under all operating conditions. For this reason, a vacuum valve means 84 has been employed to meter the flow of the vaporized water-alcohol mixture into the engine. Under the cold idle conditions depicted in FIG. 1, the vacuum line 85 will see pressure conditions in the venturi 12 which are close to atmospheric. Under these conditions, the vacuum line will cause the vacuum line 84 to partially cut off the flow of the vaporized water-alcohol injection mixture. However, it is desirable to maintain some degree of flow even under idle conditions, and this flow is provided for by a bypass line 86 which is desirably about 0.030 inches inside diameter. Regardless of the operating conditions of the engine, the vaporized water-alcohol fuel mixture will conducted from the downstream side of the vacuum valve 84 by a line 88 which terminates in the carburetor housing at 90, immediately downstream from the throttle plate 14.

Other components of the system shown in FIG. 1 include an enclosure 58 for the heating element housing 60, a thermostat 70 which controls the electrical current which actuates the heating coil 62, electric terminals 76 and 80 for the heating coil 82, as well as an indicator lamp 78 viewable by the operator of the engine.

Figure 2:
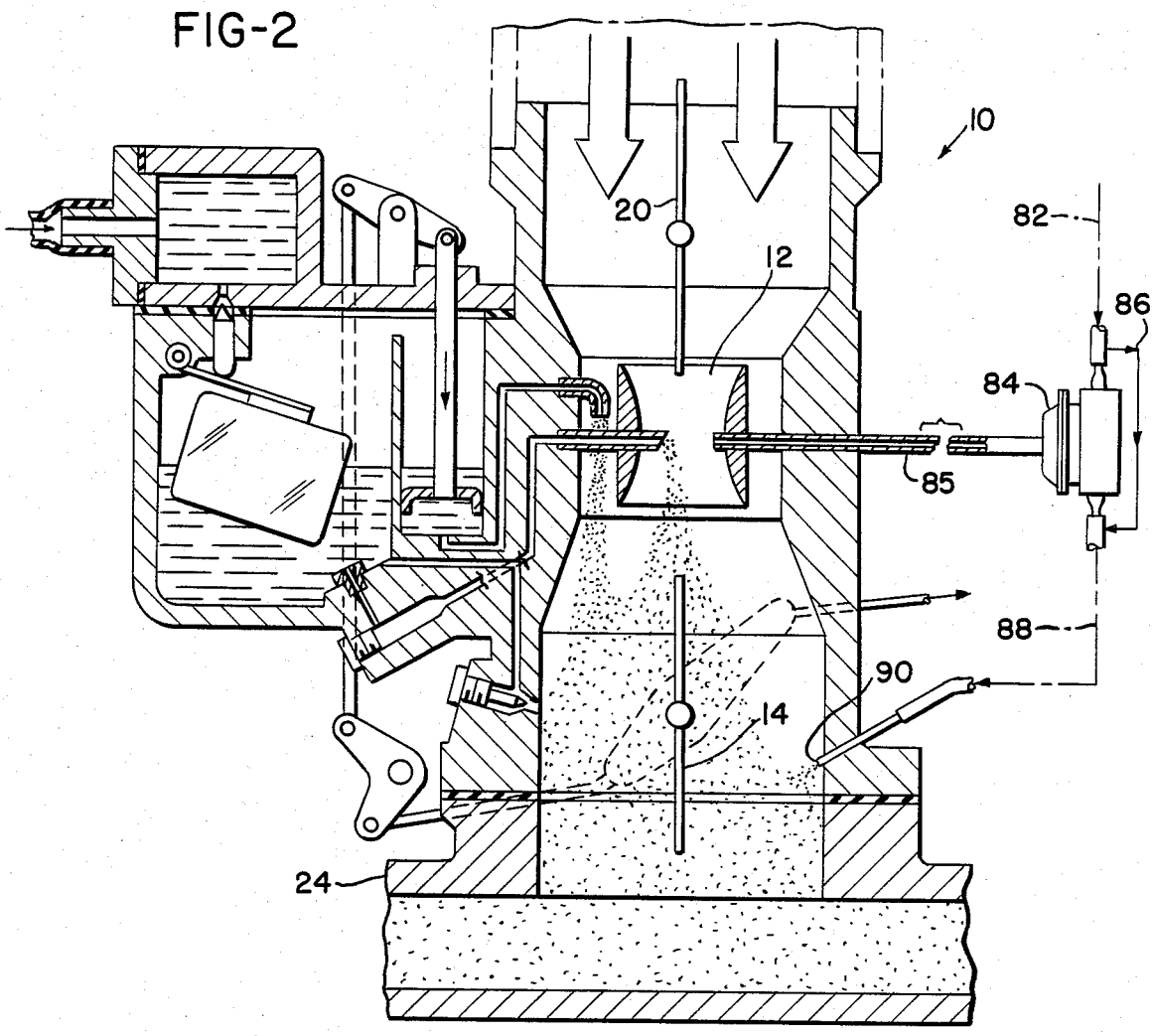
FIG. 2 shows a detailed portion of the view shown in FIG. 1, depicting the operation of the carburetor employing the system of this invention under full acceleration conditions; and, FIG. 3 is an electrical schematic diagram for one embodiment of the system of this invention.

FIG. 2 shows the fuel intake system of FIG. 1 under full acceleration conditions. The carburetor 10 again has a throttle plate 14 and a choke plate 20 as well as a venturi region 12. As can be seen by the respective positions of the choke plate 20 and the throttle plate 14, the accelerator pedal has been depressed fully and the carburetor is operating at full capacity. Under these conditions, the vacuum line 85 which controls the vacuum line 84 will see a relatively high vacuum condition (low pressure) which will act to open the vacuum valve 84 and allow the vaporized water-alcohol injection mixture from line 82 to pass substantially unimpeded through the vacuum valve 84 into the line 88 on the downstream side of the vacuum valve 84. Of course, the bypass line 86 still acts to pass a small amount of vaporized water-alchol injection mixture; however, its effects are not significant under these conditions. The vaporized water-alcohol injection mixture then enters into the fuel intake system of the engine through the outlet 90. The vaporized water-alcohol injection mixture mixes with the gasoline-air mixture from the carbureter and passes into the intake manifold for delivery into the various combustion chambers, not shown.

Figure 3:
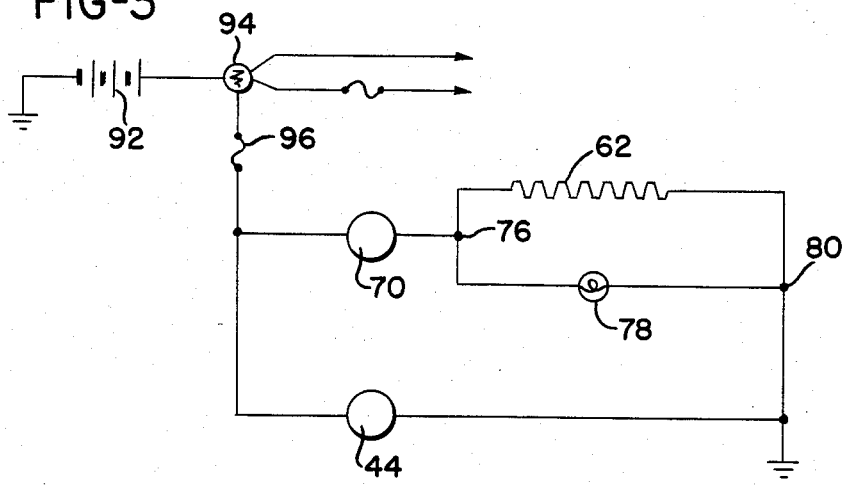

FIG. 3 shows a schematic diagram of the electrical system of this invention. In this embodiment the electrical system is powered by the primary battery for the car, commonly a 12-volt battery 92. In this diagram the system is routed through the ignition switch 94 provided as standard equipment with the engine. However, in some applications it will be desirable to employ a slightly different switch in which an intermediate position may be utilized which actuates only the supplemental heated water-alcohol injection system of this invention prior to the starting of the main engine in situations in which a fast reliable start is required. For these applications, this would allow the water-alcohol mixture to be preheated and vaporized at effective conditions of pressure and temperature for delivery into the fuel intake system of the engine to ensure a fast, positive start once the main engine is started by the conventional operation of the ignition switch. The electrical system includes a fuse 96, a thermostat 70 which controls the operation of and prevents overheating of the heater coil 62, an indicator light 78 visible to the operator of the engine, and the injection system fuel pump 44.

During the initial development of this injection system, the backflow return line 50 shown in FIG. 1 was not present. With the lack of this backflow line 50, the system, as initially developed, often would fail to function properly. Although not completely understood, it seemed that the pressure buildup within the heating chamber 64 upon the vaporization of the water-alcohol mixture by the heating coil 62, there would be a surge of back pressure through line 56 all the way back to the electrical fuel pump 44. The positive pressure at the output of the fuel pump 44 would apparently fight against the back pressure from the heating chamber 64 and cause the system to lock up. This condition would be particularly likely to happen under idle conditions when the vacuum valve 84 would shut off the majority of the vaporized water-alcohol flow to the engine, thereby causing a pressure backup in the system. However, once the backflow vent line 50 was provided to the system, these problems ceased. The backflow line 50 then conducts any excess back pressure from the heating chamber 64 back to the water-alcohol liquid reservoir 40. In FIG. 1 the backflow line 50 is shown with a vent to the atmosphere 53 adjacent to the four-way coupling 52. This vent could also be provided at the water-alcohol tank 40. The backflow line 50 also serves the useful purpose of conducting any excess water-alcohol liquid mixture provided by the injection pump 44 which is unable to be utilized by the heating chamber 64 due to the closing of the vacuum valve 84.

The system of this invention provides for automatic operation under all normal modes of the engine. Under cold idle conditions, there will be an intermediate vacuum condition in the venturi 12 as shown in FIG. 1 causing a partial opening of the vacuum valve 84. This intermediate vacuum condition is somewhere between a warm idle condition which causes essentially atmospheric pressure conditions within the venturi and a full throttle condition which produces very high vacuum conditions within the venturi. For warm idle conditions, the vacuum valve 84 is closed because the vacuum line 85 sees essentially atmospheric conditions. Under warm idle conditions, the only vaporized water-alcohol injection mixture which passes into the engine is that which flows through the bypass line 86. Under cold idle conditions, not only does the vaporized water-alcohol mixture pass through the bypass line 86, but also a limited amount passes through the vacuum valve 84 and on into the fuel intake system of the engine through the outlet 90. Under full throttle conditions, the vacuum line sees a very high vacuum (low pressure) condition within the venturi 12 and operates to open the vacuum valve fully such that a maximum flow of vaporized water-alcohol injection mixture may pass into the engine fuel intake system. It is important to note that, once the valve means 48, commonly a needle valve, has been adjusted such that the system operates efficiently, further operation of this system will be automatic for most altitudes and atmospheric pressure conditions. Also, due to the non intrusive integration of the injection system of this invention into a conventional fuel system for an internal combustion engine, should the system of this invention fail, the primary fuel system for the engine can continue to operate in a normal manner without adverse effects.

The preferred ratio of alcohol to water in the injected mixture will normally range from about 3:1 in cooler climates to about 1:1 in warmer climates. This ratio is not particularly critical, however, and there is considerable tolerance for the varying amounts of water commonly found in "pure" alcohol. The alcohol contemplated for use will normally be ethyl alcohol; however, other alcohols may be used as well.

As mentioned hereinabove, the injection of this heated alcohol-water fuel mixture results in very significant increases in engine efficiency and performance. Overall fuel economy increases for tested engines have ranged as high as 50 percent. It appears that at least a portion of this increased efficiency is due to the effects of the injected alcohol-water fuel mixture upon the combustion efficiency within the combustion chambers of the engine. It is thought that these effects relate in large part to the behavior of the increased steam component present. The heated alcohol-water mixture is introduced into the fuel intake system of the engine as a sort of wet steam at about 300° F. and is introduced into the combustion chamber at about the same temperature. However, the ignition and combustion of the gasoline-air mixture along with the alcohol produces temperatures in excess of 1600° F. which act to superheat the steam and greatly expand it. This steam expansion effect has several beneficial effects. First, the expansion adds power to the engine by doing work against the piston head. Also, the inert steam component acts as a sort of shock absorber to damper and smooth out the sharp explosive pulse of the burning gasoline fuel. This is also accompanied by a general slowing of the burning gasoline fuel. This is also accompanied by a general slowing of the burning of the gasoline within the chamber as evidenced by the fact that the engine's ignition timing can be advanced many degrees before normal setting without encountering pre-ignition knocking when the heated alcohol-water mixture is used. The general efficiency of the system is also demonstrated by a marked increase in the idle speed of the engine once the heated alcohol-water fuel mixture injection is begun. Due to these effects, the internal combustion engine operated in accordance with this invention may be deemed a modified steam engine.

I claim:

1. In a gasoline burning internal combustion engine having a carbureted fuel intake system, a heated water-alcohol injection system comprising:

means for storing a mixture comprising liquid water and alcohol, means for electrically heating the mixture to a gaseous state;

pump means in combination with fluid conduit means to convey the mixture from the mixture storing means to the heating means;

backflow vent means connecting a point in the fluid conduit means intermediate the pump means and the heating means to the storage means; and means to controllably deliver the heated mixture from the heating means to the fuel intake system of the engine.

2. The system of claim 1 wherein the fluid conduit means between the pump means and the backflow vent means contains a manually operated adjustable valve means.

3. The system of claim 1 wherein the heating means comprises an electrical heating element means.

4. The electrical heating element means of claim 3 wherein the heating element means is controlled by thermostat means.

5. The thermostat means of claim 4 wherein the thermostat means are responsive to temperature conditions within the heating means.

6. The system of claim 1 wherein the means to controllably deliver the heated mixture comprises means responsive to vacuum pressure conditions within the fuel intake system of the engine.

7. The responsive means of claim 6 wherein said means comprise a vacuum valve means wherein the vacuum valve means substantially closes under pressure conditions within the fuel intake system which are substantially the same as ambient atmospheric pressure and increasingly opens as the pressure within the fuel intake systems decreases in relation to ambient atmospheric pressure.

8. The responsive means of claim 7 further comprising a bypass line means which allows an effective amount of heated mixture to pass into the fuel intake system of the engine during said pressure conditions.

9. The bypass line means of claim 8 wherein the bypass line means comprise a line having an inside diameter of about 0.030 inches disposed with one end adjacent to and in fluid communication with the inlet side of the vacuum valve means and with the other end adjacent to and in fluid communication with the outlet side of the vacuum valve means.

10. The system of claim 3 wherein the heating means comprises an enclosed, hollow chamber containing the electric heating element means and inlet and outlet means for the passage of the mixture therethrough.

11. The system of claim 1 wherein the backflow vent means further comprises an atmospheric vent means.

12. The system of claim 1 wherein the fluid conduit means further comprises filter means.

13. A method of operating a gasoline burning internal combustion engine having a carbureted fuel intake system as a modified steam engine by the operation of a heated alcohol-water injection system comprising:

storing a mixture comprising liquid water and alcohol in storage means;

heating the mixture to a gaseous state in heating means;

pumping the mixture by pump means through fluid conduit means from the storage means to the heating means wherein the fluid conduit means includes backflow vent means intermediate the pump means and the heating means, such vent means being in fluid communication with the storage means; and controllably delivering the heated mixture from the heating means to the fuel intake system of the engine and therethrough to the combustion chambers of the engine.

14. The method of claim 13 wherein the fluid conduit means between the pump means and the backflow vent means contains a manually operated adjustable valve means.

15. The method of claim 13 wherein the heating means comprises an electrical heating element means.

16. The method of claim 13 wherein the heating means is controlled by thermostat means.

17. The method of claim 13 wherein the means to controllably deliver the heated mixture comprises means responsive to vacuum pressure conditions within the fuel intake system of the engine.

18. The method of claim 17 wherein the responsive means comprises a vacuum valve means wherein the vacuum valve means substantially closes under pressure conditions within the fuel intake system which are substantially the same as ambient atmospheric pressure and increasingly opens as the pressure within the fuel intake systems decreases in relation to ambient atmospheric pressure.

19. The method of claim 13 wherein the backflow vent means further comprises an atmospheric vent means.

20. The method of claim 13 wherein the fluid conduit means further comprises filter means.

* * * * *